US005659913A

United States Patent [19]

Toscanini et al.

[11] Patent Number: 5,659,913

[45] Date of Patent: Aug. 26, 1997

[54] SHOE STRETCHING LAST WITH A ONE-WAY LOCKING DEVICE

[75] Inventors: Ettore Toscanini; Giovanni Toscanini, both of Isolella Sesia, Italy

[73] Assignee: Industrie Toscanini S.a.s., Isolella Sesia, Italy

[21] Appl. No.: 538,823

[22] Filed: Oct. 5, 1995

[30] Foreign Application Priority Data

Oct. 7, 1994 [IT] Italy ..... TO94A0785

[51] Int. Cl.[6] ..... A43D 3/00; A43D 15/00

[52] U.S. Cl. ..... 12/135 A; 12/115.6; 12/117.4

[58] Field of Search ..... 12/135 A, 114.2, 12/115.6, 117.4

[56] References Cited

U.S. PATENT DOCUMENTS

| | | | |
|---|---|---|---|
| 926,750 | 7/1909 | Kohler | 12/117.4 X |
| 947,387 | 1/1910 | Kosters | 12/115.6 |
| 1,021,834 | 4/1912 | Hansen | 12/117.4 |
| 1,723,949 | 8/1929 | Mottert | 12/117.4 |
| 2,158,394 | 5/1939 | Baas | 12/115.6 |
| 4,718,135 | 1/1988 | Colvin | 12/114.2 X |

FOREIGN PATENT DOCUMENTS

| | | | |
|---|---|---|---|
| 0121736 | 10/1984 | European Pat. Off. | 12/114.2 |

*Primary Examiner*—B. Dayoan

*Attorney, Agent, or Firm*—Sughrue, Mion, Zinn, Macpeak & Seas

[57] ABSTRACT

A shoe stretching last includes a tiptoe portion and a heel portion. A body is connected to the heel portion and a stem is connected to the tiptoe portion and is slidably mounted within the body. A locking plate and a pushing plate are slidably mounted on the stem within the body. A first spring normally biases the locking plate into an inclined condition to prevent sliding movement of the stem toward a position of minimum length of the last. A second spring normally biases the pushing plate to an orthogonal position relative to the stem. A control lever is pivotally mounted on the body for engagement with the pushing plate to move the pushing plate to an inclined position whereupon it grips the stem to lengthen the last. The pivotal movement may be repeated to incrementally increase the length of the last. Upon pivotal movement of the lever in the opposite direction, the lever engages the locking plate to unlock the locking plate from the stem to allow the last to move to the minimum length position.

4 Claims, 2 Drawing Sheets

SHOE STRETCHING LAST WITH A ONE-WAY LOCKING DEVICE

BACKGROUND OF THE INVENTION

The present invention relates to the field of shoe stretching lasts, i.e. devices for maintaining the shape of a shoe.

According to the conventional art, these lasts comprise a tiptoe portion and a heel portion connected to each other by spring means tending to maintain them in a spaced apart position, corresponding to a configuration of maximum length of the last. This last is introduced into a shoe by moving the tiptoe portion and the heel portion closer to each other, so as to put said spring means under tension, so that, once the last has been introduced, the spring means maintain the shoe in a stretched condition.

The main drawback of the above mentioned conventional stretching lasts lies in that the tensioning force is a function of the deformation of the above mentioned spring means, so that this force may become either too high for short shoes or too small for long shoes.

SUMMARY OF THE INVENTION

The object of the present invention is that of providing a shoe stretching last in which the degree of stretching is adjustable at will for a same shoe, while providing at the same time a simple and unexpensive structure.

In order to achieve this object, the invention provides a shoe stretching last, characterized in that it comprises:

a tiptoe portion and a heel portion which are slidably mounted relative to each other between a close position, corresponding to a minimum length of the last, and a spaced apart position, corresponding to a maximum length of the last, control means for causing a lengthening of the last, one-way locking means for preventing a shortening of the last, so as to lock the last in any lengthened position intermediate between its position of minimum length and its position of maximum length, and means for releasing said locking means so as to allow the last to be shortened.

According to a further important feature of the invention, said control means and said means for releasing the locking means are controlled by a same control lever.

In a preferred embodiment, the last comprises a body connected to the heel portion, and a stem connected to the tiptoe portion which is slidably mounted within said body. This embodiment is further characterized in that:

BRIEF DESCRIPTION OF THE INVENTION the one-way locking means for the last comprises a locking plate through which said stem slidably extends, said locking plate being normally kept by the spring means in an inclined condition with respect to a plane orthogonal to the stem, in which condition the locking plate prevents the stem from sliding towards the position of minimum length of the last, while preventing a sliding movement of the stem in the opposite direction, said control means for lengthening the last comprises a pushing plate through which the stem slidably extends, said pushing plate being normally kept by spring means against a fixed abutment surface, in a position in which said pushing plate does not interfere with said stem said control means further comprising a control lever for urging the pushing plate to an inclined position, with respect to a plane orthogonal to said stem, in which said pushing plate is operatively connected to the stem, so as to move the stem therewith.

Said control lever has a neutral central position, a first end position in which it can be repeatedly, brought to move said pushing plate in order to cause a lengthening step by step of the last, and a second end position in which said lever urges said locking plate towards a position orthogonal to said stem, so as to release the locking of the stem.

In use, the last is introduced into a shoe while being in its condition of minimum length. Once the last has been introduced into the shoe, one acts on the control lever so as to bring the latter towards its first end position, thus lengthening the last by a step. Once this end position has been reached, the control lever moves back to its neutral central position due to the bias of the spring means associated with the pushing plate, while the stem remains in its newly reached position, due to the action of the locking plate. The control lever may be driven again repeatedly so as to extend the stem by the requested number of steps. When the last must be removed from the shoe, the same control lever is brought to its second end position, so as to release the locking plate which therefore does not prevent any longer a shortening of the last. The latter may be then brought to its position of minimum length, so that it can be withdrawn from the shoe.

The last according to the invention thus enables the user to adjust the degree of stretching of a same shoe at will. At the same time it is constituted by a reduced number of parts and is simple and inexpensive to manufacture.

In a preferred embodiment, there are provided spring means to automatically return the last to its condition of minimum length following the releasing of said locking means.

Further features and advantages of the invention will become apparent from the description which follows with reference to the annexed drawings, given purely by way of non limiting example, in which:

FIG. 1 is a diagrammatic side view of the stretching last according to the invention in the condition of minimum length, FIG. 2 is a diagrammatic side view of the stretching last according to the invention in the condition of maximum length, FIGS. 3–5 show a cross-sectional view of the central part of the last in three different operative conditions, and FIG. 6 shows a variant of FIG. 3.

DETAILED DESCRIPTION OF THE INVENTION

Figure 1:
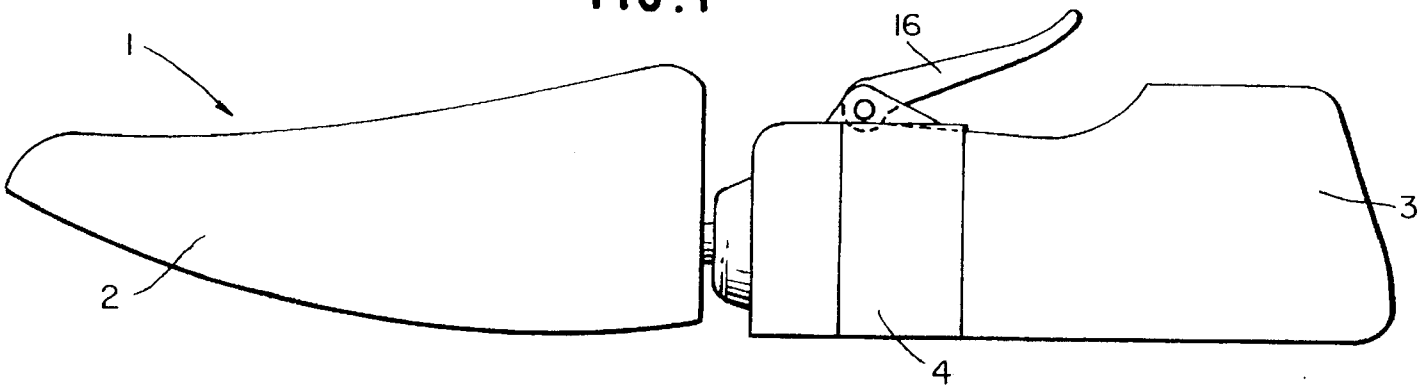
Figure 2:
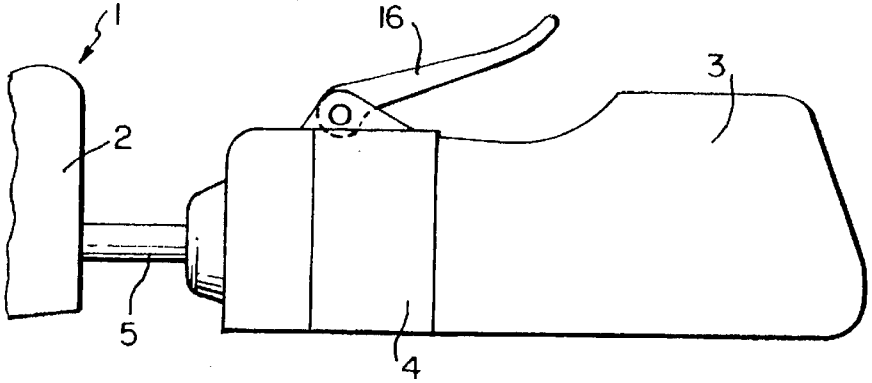

With reference to FIGS. 1, 2, numeral 1 generally designates a shoe stretching last, having a tiptoe portion 2, for example of wood or plastics and a heel portion 3 of the same material connected to a central body 4. To the tiptoe portion 2 there is connected a stem 5 which is slidably mounted within body 4 so that the last 1 may assume any intermediate position between the position of minimum length shown in FIG. 1 and the position of maximum length shown in FIG. 2.

Figure 3:
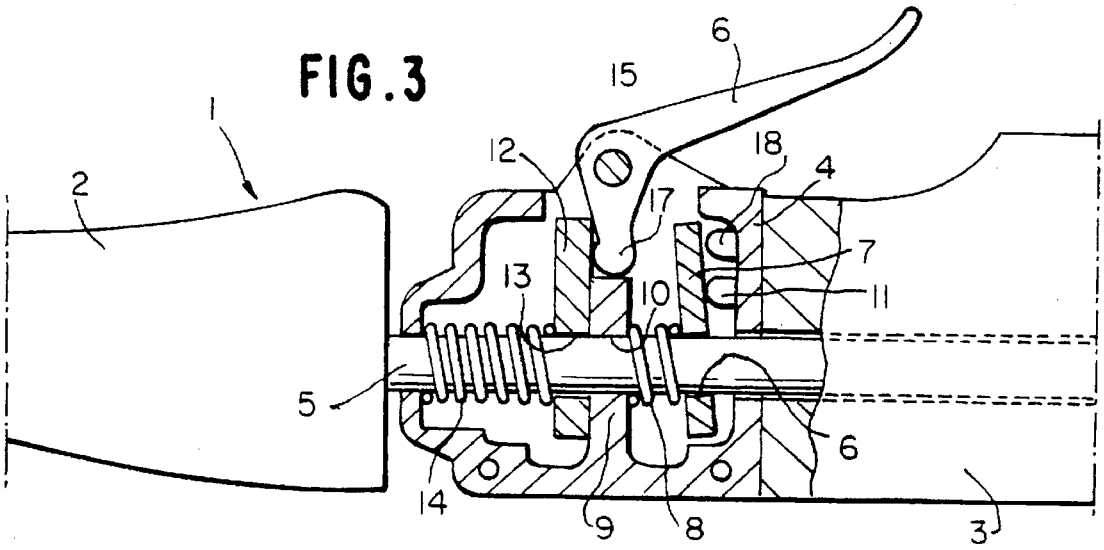
Figure 4:
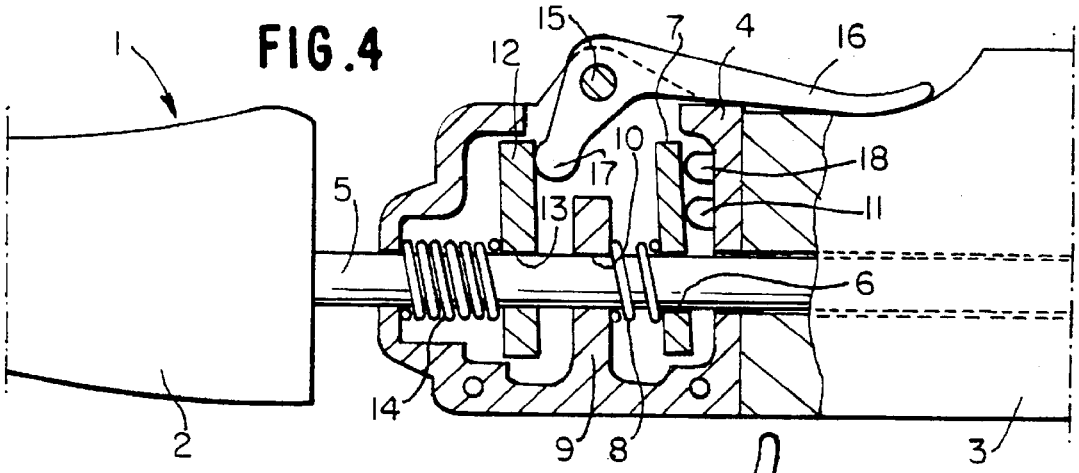
Figure 5:
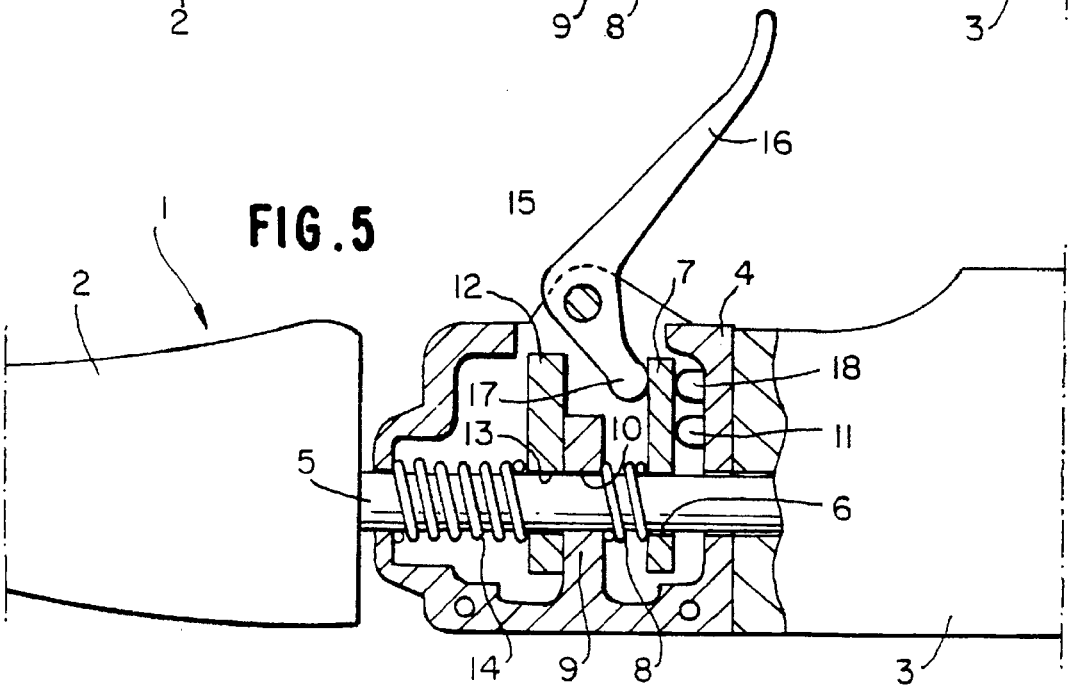

With reference to FIGS. 3–5, the stem 5 extends through a hole 6 Of a locking plate 7 which is biased by a helical spring 8 interposed between plate 7 and an inner wall 9 of body 4 which has a hole 10 through which the stem 5 extends. At its upper portion, the locking plate 7 abuts against a projection 11 of body 4, so that spring 8 tends to maintain plate 7 in an inclined position relative to a plane orthogonal to the axis of stem 5. Due to this arrangement, locking plate 7 prevents a sliding movement of stem 5 rightwardly (with reference to the drawings) i.e. in the direction of shortening of the last, whereas a sliding movement of the stem 5 leftwardly is not prevented, since in this case plate 7 tends to position itself in a plane orthogonal to the axis of stem 5.

On the other side of inner wall 9 of body 4 there is arranged a pushing plate 12 having a hole 13 through which stem 5 extends, this pushing plate 12 being subject to the action of a helical spring 14 which tends to maintain plate 12 against inner wall 9.

Onto body 9 there is articulated around a transverse horizontal axis 15 a control lever 16.

In the condition shown in FIG. 3, lever 16 is in its neutral central position. Starting from this position, lever 16 may be lowered towards the position shown in FIG. 4, so that an arm 17 rigidly connected to lever 16 urges the upper part of the pushing plate 12 moving this plate leftwardly (with reference to the drawings) and causing this plate to become inclined relative to a plane orthogonal to the axis of stem 5. Due to this inclination, the pushing plate 12 becomes operatively connected to stem 5 so that it causes a leftward movement of the stem, against the action of spring 14. Once the end position of the pushing plate 12 which is shown in FIG. 4 is reached, lever 16 may be brought back to its neutral central position shown in FIG. 3. In this condition, the pushing plate 12 returns to the position in abutment against the inner wall 9 under the action of the helical spring 14, whereas stem 5 remains in its condition extended by a step shown in FIG. 4 due to the locking action of the locking plate 7. If one wishes to further lengthen the last, it is possible to act repeatedly on lever 16 so as to bring it many times to its operative position shown in FIG. 4, so as to cause each time stem 5 to advance by a step, covering an overall stroke of 60–70 mm. When the requested degree of shoe stretching has been reached, lever 16 may be left in its neutral position shown in FIG. 3. If one wishes to withdraw the last from the shoe, it is necessary to act on lever 16 bringing it to its opposite end position, shown in FIG. 5, in which arm 17 acts against the upper part of plate 7 so as to push it against a further projection 18 of body 4. Thus, plate 7 is positioned in a plane orthogonal to the axis of stem 5 and does not prevent any longer a shortening of the last.

As it clearly appears from the foregoing description, the last according to the invention enables the degree of tensioning to be adjusted at will, for a same type of shoe, contrary to what is possible with the lasts of conventional type. Furthermore, in the last according to the invention, the lengthening of the last and its release are actuated by the same control lever, thus providing a device which is simple and unexpensive to manufacture and easy to use.

Figure 6:
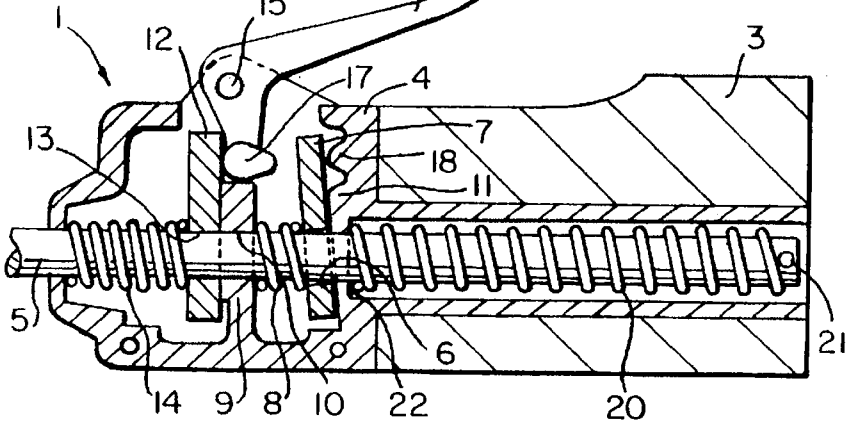

FIG. 6 shows a variant of FIG. 3 which differs only for the addition of a helical spring 20 on the rear portion of stem 5, which is interposed between a fixed surface 22 of the heel portion 3 and a transverse pin 21 mounted onto the end of stem 5. Spring 20 returns automatically last 1 to the configuration of minimum length when the locking plate 7 is released.

Naturally, while the principle of the invention remains the same, the details of construction and the embodiments may widely vary with respect to what has been described and illustrated purely by way of example, without departing from the scope of the present invention.

What is claimed is:

1. Shoe stretching last, comprising:

a tiptoe portion and a heel portion which are slidably mounted relative to each other between a close position, corresponding to a minimum length of the last, and a spaced apart position, corresponding to a maximum length of the last, control means disposed between said tiptoe portion and said heel portion for causing a lengthening of the last, one-way locking means associated with said control means to prevent a shortening of the last, so as to lock the last in any lengthened position intermediate between the position of minimum length and the position of maximum length of the last, and means associated with said control means for releasing said locking means, in order to allow the last to be shortened, wherein said last comprises a body connected to the heel portion and a stem connected to the tiptoe portion which is slidably mounted within said body, said last being further characterized in that said one-way locking means for the last comprises a locking plate through which said stem slidably extends, said locking plate being normally kept by spring means in an inclined condition, with respect to a plane orthogonal to the stem, in which it prevents a sliding movement of said stem towards the position of minimum length of the last, said locking plate allowing a sliding movement of the stem in the opposite direction, and said control means for the lengthening of the last comprises a pushing plate through which said stem extends, said pushing plate being normally kept by spring means against a fixed abutment surface, in a position in which it does not interfere with said stem, said control means further comprising a control lever to urge said pushing plate to an inclined position, relative to a plane orthogonal to the stem, in which it is operatively connected to the stem, so as to move the stem therewith.

2. Shoe stretching last according to claim 1, characterized in that said control means and said means for releasing said locking means are controlled by a same control lever.

3. Shoe stretching last according to claim 1, wherein said control lever has a neutral central position, a first end position in which it can be repeatedly brought in order to urge said pushing plate so as to cause a lengthening step by step of the last and a second end position in which it acts against said locking plate to bring the latter to a position orthogonal to the stem, so as to release the locking of the stem.

4. Shoe stretching last according to claim 1, further comprising additional spring means for automatically returning the last to its condition of minimum length when said one-way locking means have been released.

* * * * *